United States Patent [19]

Clift

[11] Patent Number: 4,655,070

[45] Date of Patent: Apr. 7, 1987

[54] SCORED CONCAVE-CONVEX RUPTURE DISK AND METHOD OF MANUFACTURE

[76] Inventor: Miner E. Clift, 2309 W. Indianola, Broken Arrow, Okla. 74012

[21] Appl. No.: 654,393

[22] Filed: Sep. 26, 1984

[51] Int. Cl.[4] ..... B21D 51/24

[52] U.S. Cl. ..... 72/325; 220/89 A

[58] Field of Search ..... 220/89 A; 72/324, 325, 72/379

[56] References Cited

U.S. PATENT DOCUMENTS

| | | | |
|---|---|---|---|
| 2,656,950 | 10/1953 | Coffman | 220/89 A |
| 2,735,390 | 2/1956 | Engel | 72/379 |
| 3,921,556 | 11/1975 | Wood et al. | 72/379 |
| 4,122,595 | 10/1978 | Wood et al. | 29/424 |
| 4,139,005 | 2/1979 | Dickey | 138/89 A |
| 4,492,103 | 1/1985 | Nauman | 72/325 |

*Primary Examiner*—Lowell A. Larson

*Attorney, Agent, or Firm*—Pravel, Gambrell, Hewitt & Kimball

[57] ABSTRACT

The present invention relates to methods of manufacturing scored concave-convex rupture disks wherein the disks are score after forming on the convex side, away from the pressure vessel or "process" of which the disk controls pressure so that product cannot build-up in the score and speed corrosion and/or alter burst pressure.

5 Claims, 9 Drawing Figures

SCORED CONCAVE-CONVEX RUPTURE DISK AND METHOD OF MANUFACTURE

BACKGROUND OF THE INVENTION

1. Technical Field

The present invention relates generally to methods of forming and manufacturing scored concave-convex rupture disks having "scores" on the surface of the rupture. More particularly, the present invention relates to scored concave-convex rupture disks and a method of manufacturing wherein the disk is formed almost to burst pressure and scored on the downstream side of the disk away from the "process."

2. Background Art

There are various types of safety pressure relief disks generally known in the industry as rupture disks. These devices include certain specialized types of rupture disks including the concave-convex buckling type rupture disks. Such rupture disks are usually supported between a pair of flanges which are in turn connected to a pipeline, pressure vessel, or other system containing a "process" which is being relieved at a fixed desired pressure by the rupture disk.

Some reverse buckling type concave-convex rupture disks have grooves upon one surface known as scores which create lines of weakness so that upon rupture, the disk tears along the lines of the weakness and thus opens without disintegrating into a number of smaller pieces which would then possibly clog the pipeline or outlet in question. An example of a reverse buckling type concave-convex rupture disk can be seen in U.S. Pat. No. 3,484,817 issued to Lorene Wood and in U.S. Pat. No. 3,921,556 entitled "Scored Reverse Buckling Rupture Disk Manufacturing Method," issued on Nov. 25, 1975. These prior art types of rupture disks normally are preliminarily scored and then "formed" in the domed shape which is characteristic of reverse buckling-type concave-convex rupture disks. Normally, the scored surface of these prior art type disks is on the surface of the disk which is adjacent a particular process being controlled by the disk. Thus, the scores are exposed to the process or a product which is part of a particular process so that build-up in the score is a problem. The build-up of product or corrosion in the score causes an alteration in burst pressure and thus an inoperability of the device.

GENERAL DISCUSSION OF THE PRESENT INVENTION

The present invention provides a method of manufacturing scored concave-convex rupture disks from sheet metal disk material in which the sheet metal is sectioned into separate blanks, each of which will become a rupture disk. A concave-convex dome is formed in each of the blanks using a pressure at or near the burst pressure of the disk. Scores are formed on the convex surface of the concave-convex dome thereby creating lines of weakness therein. In the preferred method of manufacture, a convex-concave dome is formed in a metal disk blank to ninety percent (90%) of its rated burst pressure before scoring. Burst pressure is found by placing a sheet metal disk blank in a test die and bursting the disk with compressed air. The scores are on the convex side of the disk—away from the "process" side so that product cannot build-up in or corrode the scores to interfere with operation of the disk. The disk is preferably of a corrosion resistant sheet metal material such as stainless steel, nickel, monel or inconel. By forming the disk to almost burst pressure (for example, a value of ninety percent (90%) burst pressure, the disk is stronger and can be used at high operating service pressures such as, for example, ninety percent (90%) burst pressure rating. Prior art type concave-convex disks typically allow only seventy to eight-five percent (70–85%) operating service. The disk can be scored by placing the concave-convex formed disk in a die and scoring the disk in, for example, four (4) sections at ninety degrees (90°) apart by compressing a hardened steel knife into the disk crown in a hydraulic press. The depth of the scores is as required for the disk to burst at the desired pressure. A deeper score will give a lower burst pressure. A desirable depth of score is, for example, forty to sixty percent (40%–60%) of the total material thickness.

BRIEF DESCRIPTION OF THE DRAWINGS

For a further understanding of the nature and objects of the present invention, reference should be had to the following detailed description, taken in conjunction with the accompanying drawings in which the parts are given like reference numerals and wherein.

DETAILED DESCRIPTION OF THE PREFERRED EMBODIMENT

Figure 1:
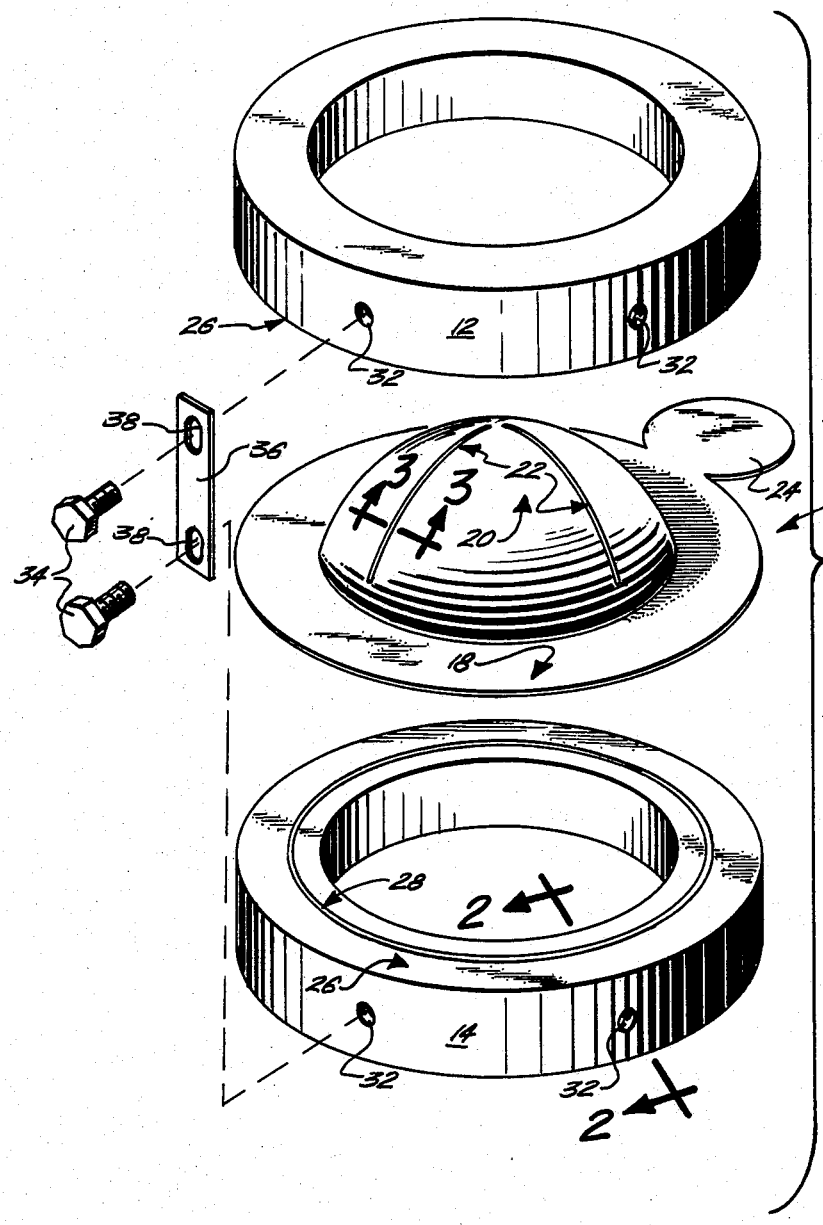
FIG. 1 is a exploded perspective view of the preferred embodiment of the apparatus of the present invention.

FIGS. 1–5 illustrate the preferred embodiment of the apparatus of the present invention designated generally by the numeral 10. In FIG. 1, a pair of spaced apart flanges 12, 14 are used to secure rupture disk 16 therebetween during operation. Disk 16 provides an annular flange portion 18 and a concave-convex dome 20 portion which is scored by means of a plurality of scores 22 on the convex side thereof. A nameplate 24 used for identification also allows gripping of disk 18 away from dome portion 20 to prevent damage thereto.

Flanges 12, 14 provide multiple threaded openings 32 to which straps 36 having openings 38 can be secured by means of threaded fasteners 34 such as bolts. The use of bolts 34 and straps 36 insures that the combination of flanges 12, 14 and disk 16 will not be damaged or disturbed during shipment and handling. Normally, the flanges 12, 14 are disk holders which are pressed together during operation by companion flanges and bolts (not shown). Thus, the strap 36 is merely a pre-use or pre-assembly strap or lug.

Figure 2:
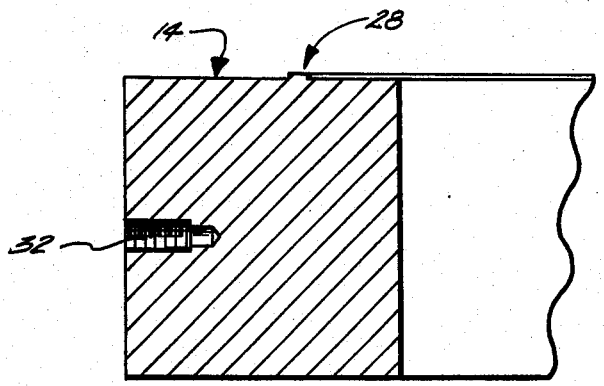
FIG. 2 is a sectional view taken along lines 2—2 of FIG. 1.

As best seen in FIG. 2, flange 14 can, for example, provide an annular raised face 28 which insures a good seal upon assembly between disk 16 and its flanges 12, 14.

Figure 3:
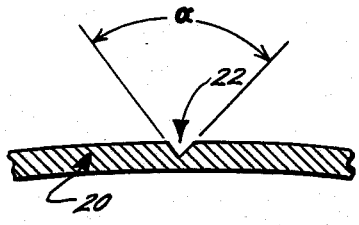
FIG. 3 is a sectional view taken along lines 3—3 of FIG. 1.
Figure 4:
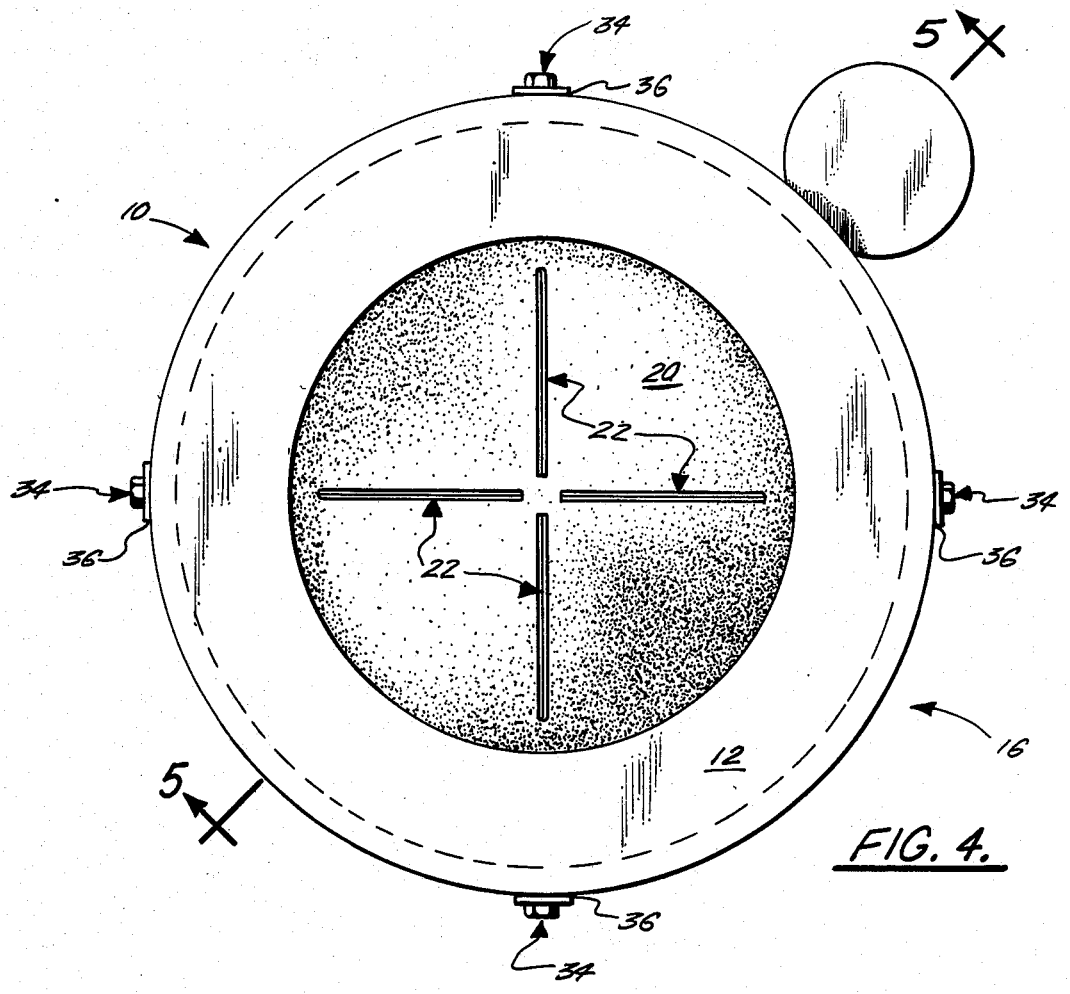
FIG. 4 is a top view of the preferred embodiment of the apparatus of the present invention.

In FIG. 3, a partial, sectional view of dome 20 illustrates a score 22 having an angle designated by the Greek Letter Alpha which is preferably sixty degrees (60°).

In the preferred embodiment, scores 22 are approximately ninety degrees (90°) apart (see FIG. 4) and are on the downstream or convex side of dome 20. This prevents the buildup of product and discourages corrosion both of which can contribute to an inoperability of the rupture disk 20 within the pressure limits for which it is designed.

Figure 5:
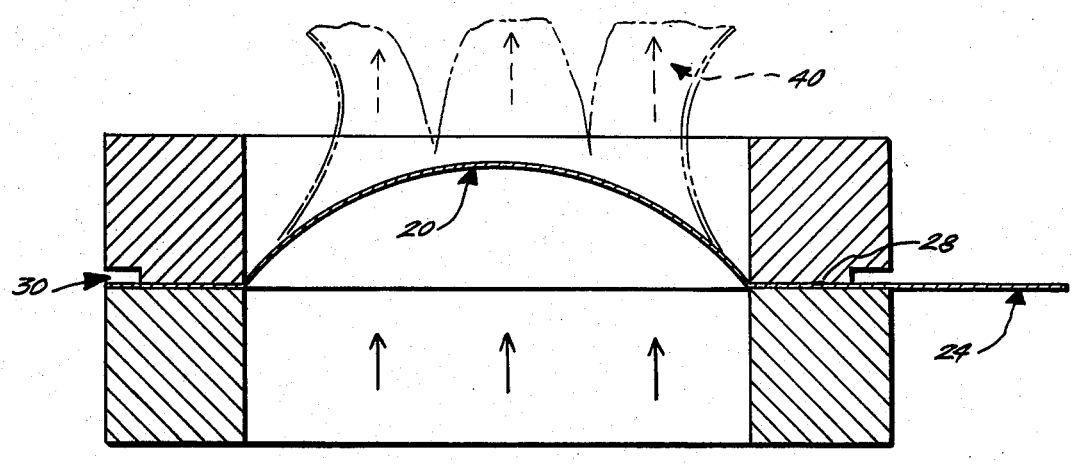
FIG. 5 is a sectional view taken along lines 5—5 of FIG. 4.

In FIG. 5, the phantom lined arrows 40 illustrate generally the shape of dome 20 after bursting with the arrows 40 schematically illustrating the escape of fluid under pressure.

Figure 6:
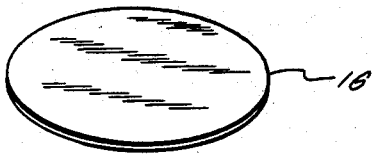
FIG. 6 is a perspective view of a section of sheet metal prior to forming.

In FIGS. 6–9, the method of manufacture of the disk 10 of the present invention is further illustrated. In FIG. 6, disk 16 is first blanked out of a corrosion resistant sheet metal material such as stainless steel, nickek, monel or inconel. The disk blank 16 is preferably circular in form and of a uniform thickness.

Figure 7:
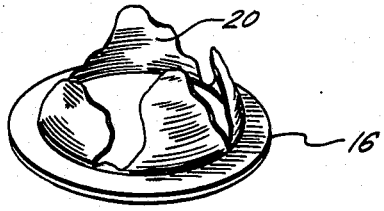
FIG. 7 is a perspective view of a formed concave-convex rupture disk after establishing disk burst pressure.

In FIG. 7, rupture of the disk has been completed during testing. The disk blank 16 is placed in a test die and burst with compressed air in order to find the burst pressure of the particular base sheet metal material selected.

Figure 8:
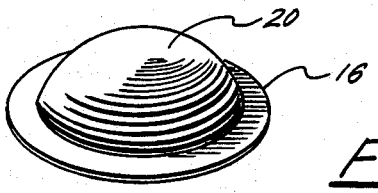
FIG. 8 is a perspective view of a concave-convex rutpure disk after forming.

In FIG. 8, a disk blank is formed to a pressure which is slightly lower than the burst pressure such as, for example, ninety percent (90%) of the burst pressure. This process makes the disk stronger and allows it to be used at approximately ninety percent (90%) of its burst rating.

Figure 9:
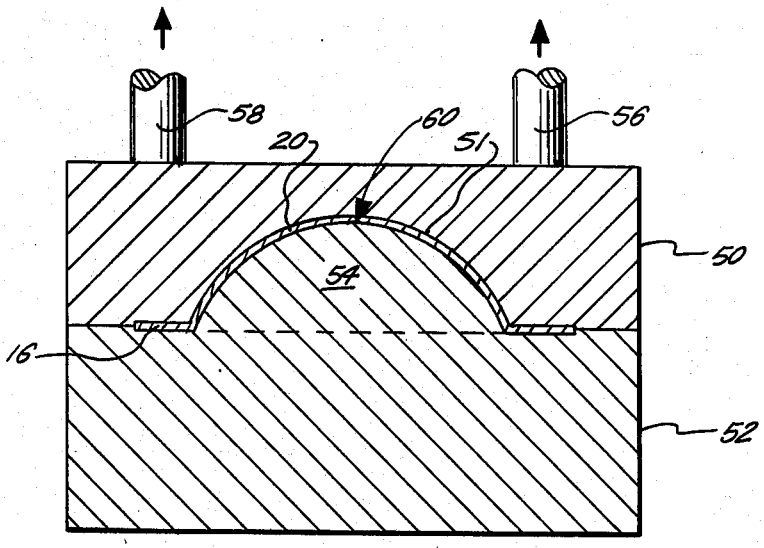
FIG. 9 is a sectional view illustrating the forming of a concanve-convex type rupture disk during forming.

FIG. 9 illustrates scoring of the disk 20 dome portion. In FIG. 9, a pair of hydraulically operated presses 50, 52 can be seen. The press 52 would be static while the press 50 would be, for example, movable. The dome 20 portion of the disk can be seen between a convex 54 portion of press 52 and a concave portion 51 of press 50. Press 50 would be supplied with one or more hardened steel knife edges 60 which would form the scores 22 on the convex surface of dome 20. The score knife provides an angle of sixty degrees (60%) which compresses and extrudes less metal during the scoring operation than knife angles of greater degree. This reduces the tendency for the disk to crack below the score while in service. Such cracking of the disk during operation is a serious problem in applications where leakage of hazardous or caustic chemicals can occur.

Because many varying and different embodiments may be made within the scope of the inventive concept herein taught, and because many modifications may be made in the embodiment of the law, it is to be understood that the details herein are to be interpreted as illustrative and not in a limiting sense.

What is claimed as invention is:

1. A method of manufacturing a scored concave-convex rupture disk having a known rupture pressure from a section of sheet metal comprising the following steps:
   a. sectioning a portion of sheet metal into a disk shaped blank;
   b. forming a concave-convex dome on the sheet metal disk blank to a pressure value slightly lower than the disk burst pressure; and
   c. forming a score on the convex surface of the concave-convex dome and after forming the concave-convex dome to a pressure value near disk burst pressure.

2. The method of claim 1 wherein the score has a cross-sectional angle of sixty degrees (60°).

3. The method of claim 1 wherein in step "b," the concave-convex dome is formed on the disk with a pressure at or near the actual burst pressure.

4. The method of claim 3 wherein the disk is formed with a pressure of ninety percent (90%) of its actual burst pressure.

5. A method of forming a scored concave-convex type rupture disk, comprising:
   a. sectioning a blank of sheet metal base disk material;
   b. determining the burst pressure on the disk base material;
   c. forming a concave-convex dome on the disk blank using a pressure of ninety percent (90%) of the disk burst pressure; and
   d. scoring the disk on one of its curved surfaces after the concave-convex surface is formed.

* * * * *